US008539736B1

(12) United States Patent
Claramonte

(10) Patent No.: US 8,539,736 B1
(45) Date of Patent: Sep. 24, 2013

(54) METHOD FOR INSTALLATION OF A TILE ASSEMBLY

(71) Applicant: Albert M. Claramonte, Miami, FL (US)

(72) Inventor: Albert M. Claramonte, Miami, FL (US)

( * ) Notice: Subject to any disclaimer, the term of this patent is extended or adjusted under 35 U.S.C. 154(b) by 0 days.

(21) Appl. No.: 13/894,813

(22) Filed: May 15, 2013

Related U.S. Application Data

(62) Division of application No. 13/080,211, filed on Apr. 5, 2011, now Pat. No. 8,464,484.

(60) Provisional application No. 61/321,045, filed on Apr. 5, 2010.

(51) Int. Cl.
*E04F 13/08* (2006.01)

(52) U.S. Cl.
USPC ..... 52/747.11; 52/389; 52/388; 52/385; 52/384

(58) Field of Classification Search
USPC ..... 52/384, 385, 388, 389, 747.11
See application file for complete search history.

(56) References Cited

U.S. PATENT DOCUMENTS

| | | | | |
|---|---|---|---|---|
| 4,324,605 | A * | 4/1982 | Bethea | 156/247 |
| 4,522,855 | A * | 6/1985 | Bethea | 428/49 |
| 4,804,569 | A * | 2/1989 | Arisawa | 428/47 |
| 2005/0205567 | A1 * | 9/2005 | Yoon | 219/756 |
| 2009/0107071 | A1 * | 4/2009 | Starke | 52/385 |
| 2009/0233034 | A1 * | 9/2009 | Saunders | 428/41.8 |
| 2010/0223872 | A1 * | 9/2010 | Taylor et al. | 52/309.3 |
| 2011/0239572 | A1 * | 10/2011 | Calapkulu | 52/390 |

* cited by examiner

*Primary Examiner* — Mark Wendell
(74) *Attorney, Agent, or Firm* — Malloy & Malloy, P.L.

(57) ABSTRACT

A do-it-yourself kit assembly and installation method for mounting a tile assembly to a predetermined support surface, such as a kitchen backsplash. The kit assembly includes the tile assembly comprised of one or more tile sheets as well as all of the installation materials and installation tools required to accomplish the do-it-yourself installation in a timely manner. Each tile sheet includes a plurality of fixed tile pieces, which may comprise glass mosaic tiles, and a self-adherent adhesive layer, which facilitates the mounting of the tile sheets to virtually any kind of surface. A ready-to-use grout supply makes it easy to apply the optimal quantity of grout onto the mounted tile sheet(s), wherein the installation materials and tools are cooperatively provided to facilitate the installation method.

19 Claims, 6 Drawing Sheets

METHOD FOR INSTALLATION OF A TILE ASSEMBLY

CLAIM OF PRIORITY

The present application is a divisional patent application of previously filed, pending application having Ser. No. 13/080,211 which was filed on Apr. 5, 2011, which is based on and claims priority to a provisional patent application having Ser. No. 61/321,045 and a filing date of Apr. 5, 2010, each of which are incorporated herein by reference in their entireties.

BACKGROUND OF THE INVENTION

1. Field of the Invention

This invention is directed to a "do-it-yourself" home remodeling kit specifically including a tile assembly which may be specifically, but not exclusively structured to be installed over a kitchen backsplash area in a minimal amount of time. The present invention is also directed to the do-it-yourself method of installation as well as certain structural features of one or more self-adherent tile sheets at least partially defining the tile assembly.

2. Description of the Related Art

A method of installing glass mosaic tile or other tile material pieces by a "do-it-yourself" basis can be complicated, time-consuming, and costly. Typically, one has to obtain not only the tile materials but must frequently visit one or more supply or remodeling stores to buy many of the required installation materials and/or tools associated with the do-it-yourself technique. In addition, the individual must already possess sufficient skill or training to accomplish such an installation in a timely manner, wherein the final product is sufficiently pleasing in appearance and structure to resemble a professional installation. Moreover, if a professional contractor or like individual is not hired to do the installation then the individual involved in the do-it-yourself technique must be skilled in a variety of different techniques, procedures and structures to accomplish a professionally appearing installation.

The installation of various tiles including mosaic glass tiles, ceramic tiles, etc. is conventionally done with a cement or "mastic" applied to the surface being covered. Such cement or mastic may be preformed and purchased separately and applied separately over the entire surface area being covered. Accordingly, the cement or mastic may have a universal composition including a standard viscosity which may secure the tile material directly to the support surface. However, in many cases a standard adhesive composition, in particular such a composition intended for a "do-it-yourself" installation, is not sufficiently strong to maintain the tile being mounted on a substantial permanent basis. Also, the application of the mastic or cement to the surface being covered must be sufficient to distribute the cement or mastic over the area in a somewhat even or at least sufficiently ample basis to maintain the permanent adherence of the tile material to the support surface.

Accordingly, there is a need in this industry for a do-it-yourself installation kit and method of installation which facilitates the application of a tile assembly to the intended surface, such as that of the present invention which incorporates a tile assembly preferably including one or more self-adherent tile sheets. As such, the obtaining, preparing, and applying mastic or cement to the surface to be covered is thereby eliminated resulting in a saving of both time and effort by the individual. As a result, a preferred and proposed kit assembly, installation method and tile assembly should comprise a self-adherent tile assembly including the aforementioned one or more plurality of tile sheets each of which include a composite structure which eliminates many of the procedures and techniques typically included in conventional do-it-yourself tile installation assemblies and methods.

Moreover, a proposed do-it-yourself kit assembly, method of installation and tile assembly incorporating the self adherent feature, should include and utilize installation materials and installation tools cooperatively provided to eliminate the problems as generally set forth above. As a result the time consuming efforts of an individual including the necessity for going to one or more supply stores to obtain a variety of different installation materials, tools, tile materials, mastic, cement, etc., would be eliminated.

SUMMARY OF THE INVENTION

The present invention relates to "do-it-yourself" kit assembly for installing a tile assembly on a support surface such as, but not limited to, a kitchen backsplash area. The present invention is also directed to a "do-it-yourself" method of installation as well as the structural and operative features of one or more tile sheets defining the tile assembly.

More specifically, the do-it-yourself kit assembly of the present invention includes at least one, but more practically a plurality of self-adherent tile sheets each comprising a backing sheet of predetermined configuration and dimension. A plurality of tile pieces are collectively and fixedly secured to an outer face of the backing sheet in spaced relation to one another. In addition, an adhesive layer is secured to a rear face of the backing sheet in opposing relation to the plurality of tile pieces. As such the adhesive layer is disposed and structured to fixedly secure the backing sheet to the support surface on a substantially permanent basis. Also, a cover sheet is removably disposed in overlying, confronting relation to a subsequently exposed surface of the adhesive layer.

In at least one preferred embodiment, the plurality of tile pieces comprises a plurality of mosaic, glass tile pieces which are preferably, but not necessarily, equally dimensioned and configured. Further, each of the tile pieces are disposed in equally spaced relation to next adjacent ones of the plurality of tiled pieces, wherein the spaces between the tiled pieces define grout channels or grout junctions. Other components of the kit assembly include a plurality of containers of grout sufficient in quantity to cover the exterior exposed surfaces of the plurality of the tile pieces, once fixedly secured to the support surface and/or kitchen backsplash. As such, the grout will be sufficient to fill the grout junctions between the plurality of tile pieces as set forth above.

In order to provide an efficient, effective "do-it-yourself" kit assembly, a plurality of installation materials and installation tools are included and are cooperative to facilitate the do-it-yourself method of installation. More specifically, the kit assembly includes at least one but more practically a plurality of tile sheets preferably, but not necessarily, structured and dimensioned to have a 12 inch by 12 inch or one square foot dimension. The installation tools include a pair of gloves to be worn by the user during the installation. Also, a cutting blade is provided so as to form/modify/adjust one or more segments of the one or more tile sheets to correspond to the dimension and configuration of the support surface and/or backsplash area to be covered.

Also, a "grout float" may be utilized to apply the supply of grout over the exposed surface of the plurality of the tile pieces as well as fill the grout junctions between the tile pieces. The grout float is also structured to be manipulated in a manner which applies a sufficient degree of pressure to the exposed surface of the one or more tile sheets. The result of applying a sufficiently greater pressure is to fixedly secure the one or more tile sheets and more specifically the adhesive layer associated therewith in a substantially permanent manner to the support surface. Other installation tools may include a plurality of spacers which may be inserted between adjacent ones of the tile pieces associated with the same tile sheet or adjacent or contiguous ones of the plurality of tile sheets so as to accomplish an accurate and effective alignment thereof.

Informational and/or instructional material, such as a printed brochure, DVD or other viewable media, etc. can also be included in the kit assembly so as to further facilitate the "do-it-yourself" method of mounting or installation. The kit assembly further includes other portions of the tile assembly which may comprise at least one, but preferably a plurality of elongated liner tiles each of which includes a one-piece construction and an adhesive layer on a rear or outer surface thereof. The adhesive layer of the liner tiles, may be the same as that associated with that one or more of the tile sheets, and is sufficient to fixedly secure the liner tiles about the periphery of the installed tile sheets. In addition, a plurality of loose tile pieces are also included in the tile assembly so as to facilitate replacement or repair of damaged or missing tile pieces which would normally be fixedly secured to the backing sheet of the corresponding tile sheet.

The do-it-yourself tile assembly kit and the various components of the kit, as generally described above, facilitate an easy, efficient and quick method of do-it-yourself installation or mounting of the tile assembly in the manner generally set forth hereinafter.

More specifically, the support surface or the backsplash area on which the tile assembly is to be mounted is cleaned at least to the extent of removing any grease, dust or other debris which would affect the installation and/or appearance to the installed tile sheets. Once the affected are of the support surface and/or backsplash has been sufficiently prepared proper measuring is done in order to coordinate the dimension and the configuration of the one or more tile sheets with the area on which the tile sheets are to be mounted. This coordination may include the cutting or severing of portions of the tile sheet to form at least one tile sheet segment which corresponds in dimension and configuration to the portion of the support surface on which it is to be mounted.

A "dry fitting" of the tile sheet is next accomplished by at least partially removing a lower portion of the cover sheet from the adhesive layer thereby exposing a corresponding portion of the adhesive layer. This exposed portion of the adhesive layer is applied to the backsplash area on which the tile sheet is to be mounted by applying only a first predetermined or minimal amount of pressure to the tile sheet. This minimal amount of applied pressure enables the removal and/or adjustment of the adhesive and tile sheet form the support surface. Once accurately aligned and positioned the remainder of the cover sheet may be removed from the adhesive layer thereby exposing the entire adhesive layer and allowing the entirety of adhesive layer to confront the area of the support surface on which it is to be mounted. A second predetermined greater pressure is then applied to the exposed face of the plurality of tile pieces, such as by using the grout float, as will be explained in greater detail hereinafter. The second, greater predetermined amount of pressure is sufficient to fixedly and substantially permanently secure the tile sheet to the backsplash or other area of the support surface.

Subsequently, the grout is applied in overlying, covering relation to the plurality of tile pieces on the sheet or sheets which have been mounted on the support surface. A sufficient amount of time is allowed for the drying or curing of the grout and some of the aforementioned cleaning materials may be used to remove excessive grout from the disposed surface of the plurality of tiles, once a drying of the grout has occurred.

Therefore, the do-it-yourself kit assembly of the present invention may be specifically utilized to cover the kitchen backsplash area and as such the plurality of sheets are sufficient in quantity, dimension, configuration, etc. to cover at least a backsplash area or other support surface area of generally about 15 square feet. Utilizing the kit assembly, preferred method of installation and taking advantage of the structural and operable self-adherent features of the one or more tile sheets, a 15 square foot support surface area can be installed with the aforementioned tile assembly in as little as one hour.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
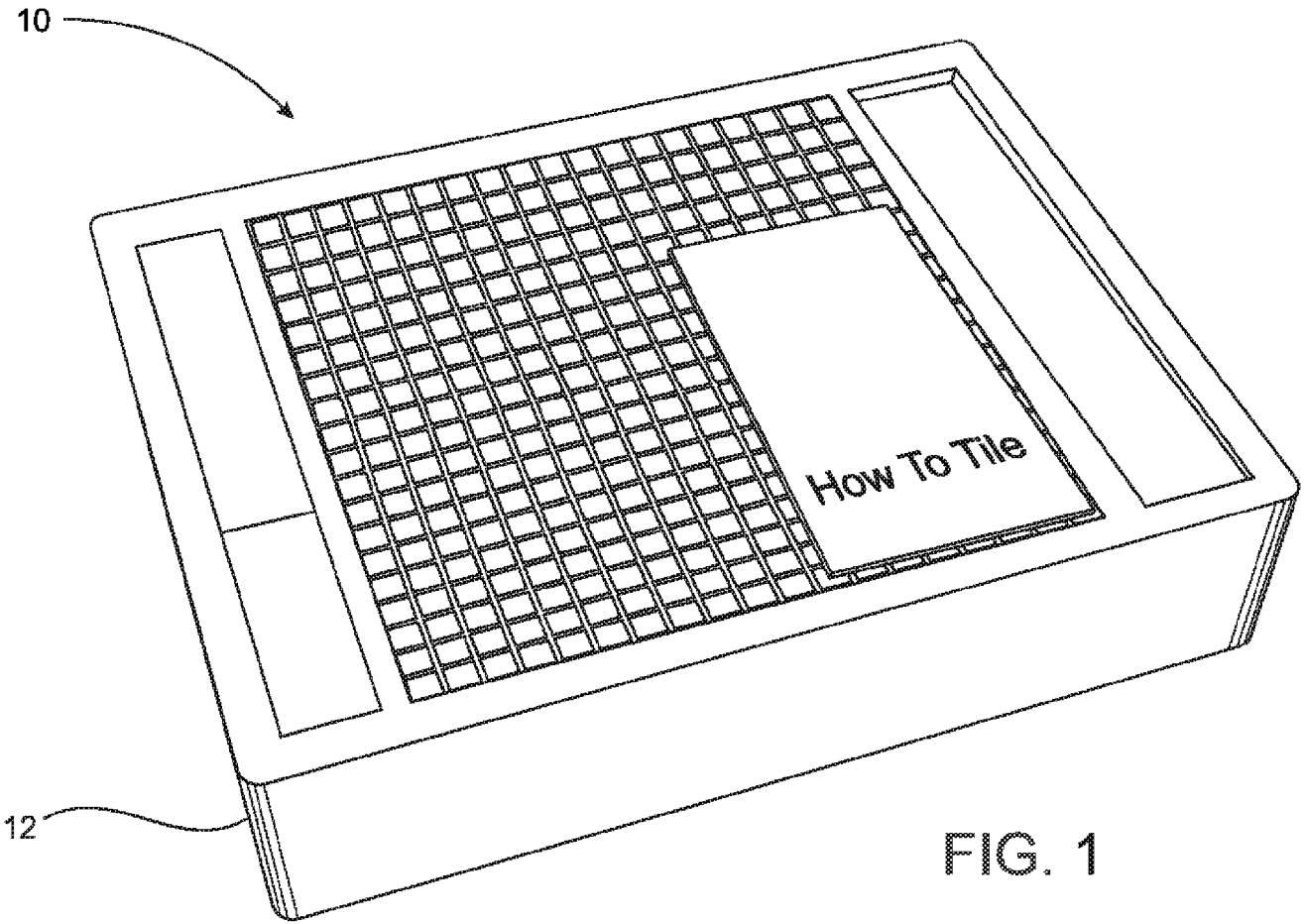
FIG. 1 is a perspective view of the kit assembly of the present invention.

As shown in the accompanying Figures, the present invention is directed towards a do-it-yourself mounting or installation kit generally indicated as 10 in FIG. 1. In addition, the present invention includes the structural and operative details of a tile assembly including one or more tile sheets and the method of installing or mounting the tile assembly in an effective, efficient and time saving manner.

Figure 7:
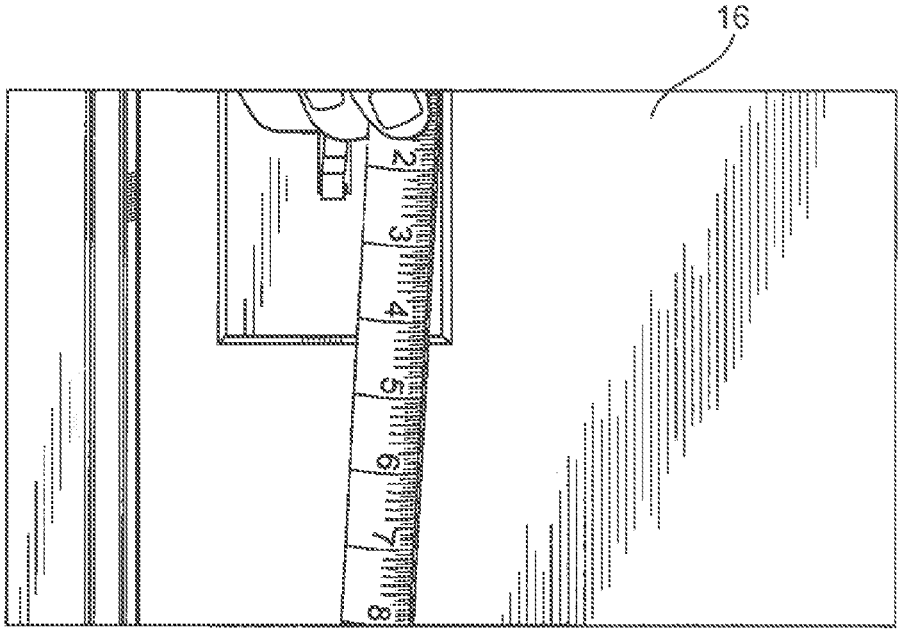
FIG. 7 is a perspective view of a portion of the do-it-yourself method of installation of the kit assembly of the embodiment of FIG. 1.
Figure 8:
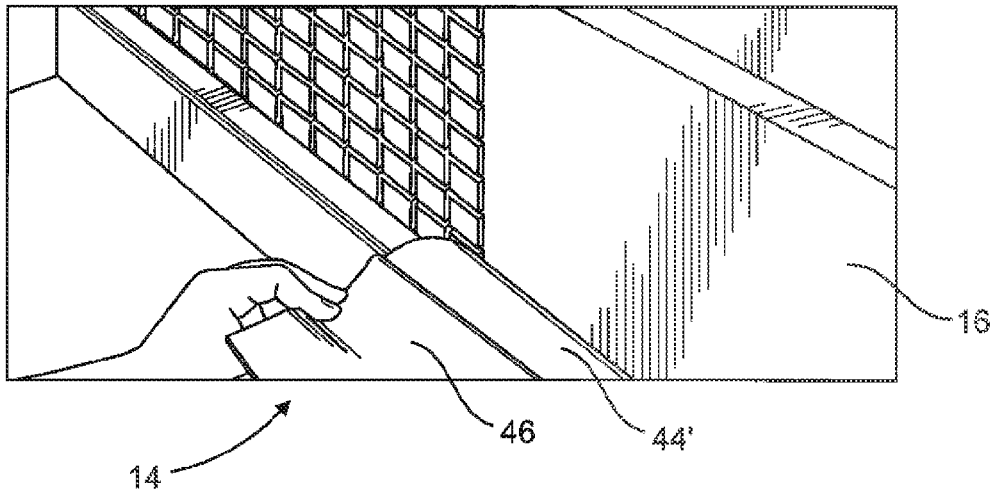
FIG. 8 is a perspective view of another portion of the do-it-yourself method of installation of the kit assembly of the embodiment of FIG. 1.

As indicated, the do-it-yourself installation assembly 10 comes in a packaged form utilizing an appropriately sized and structured container 12. With primary reference to FIG. 2, the various components of the kit assembly 10 are collectively represented and include at least one but more practically a plurality of tile sheets 14 as well as a plurality of installation materials and installation tools. When combined and used as intended, the installation materials and tools facilitate the do-it-yourself method of installation of the one or more tile sheets 14 on a predetermined area of a support surface 16, as generally represented in FIGS. 7 and 8. More specifically, the dimension, configuration and number of tile sheets 14 may be such as to facilitate the mounting or installation of the tile sheets on a predetermined area of the support surface 16. By way of example only, an intended area for installation of the support surface 16 may be a kitchen backsplash area. As such, the size and quantity of the plurality of tile sheets 14 are sufficient to cover a typical surface area, such as being in the range of 15 square feet. However, it is emphasized that the versatility of the do-it-yourself installation kit 10, attendant method and structural features of the tile sheets 14 are such that the present invention could be applied a variety of other support surfaces, having a variety of greater or smaller sizes other than the referred to kitchen backsplash area. Accordingly, the support surface 16 being a kitchen backsplash is referred to by way of example only.

Figure 2:
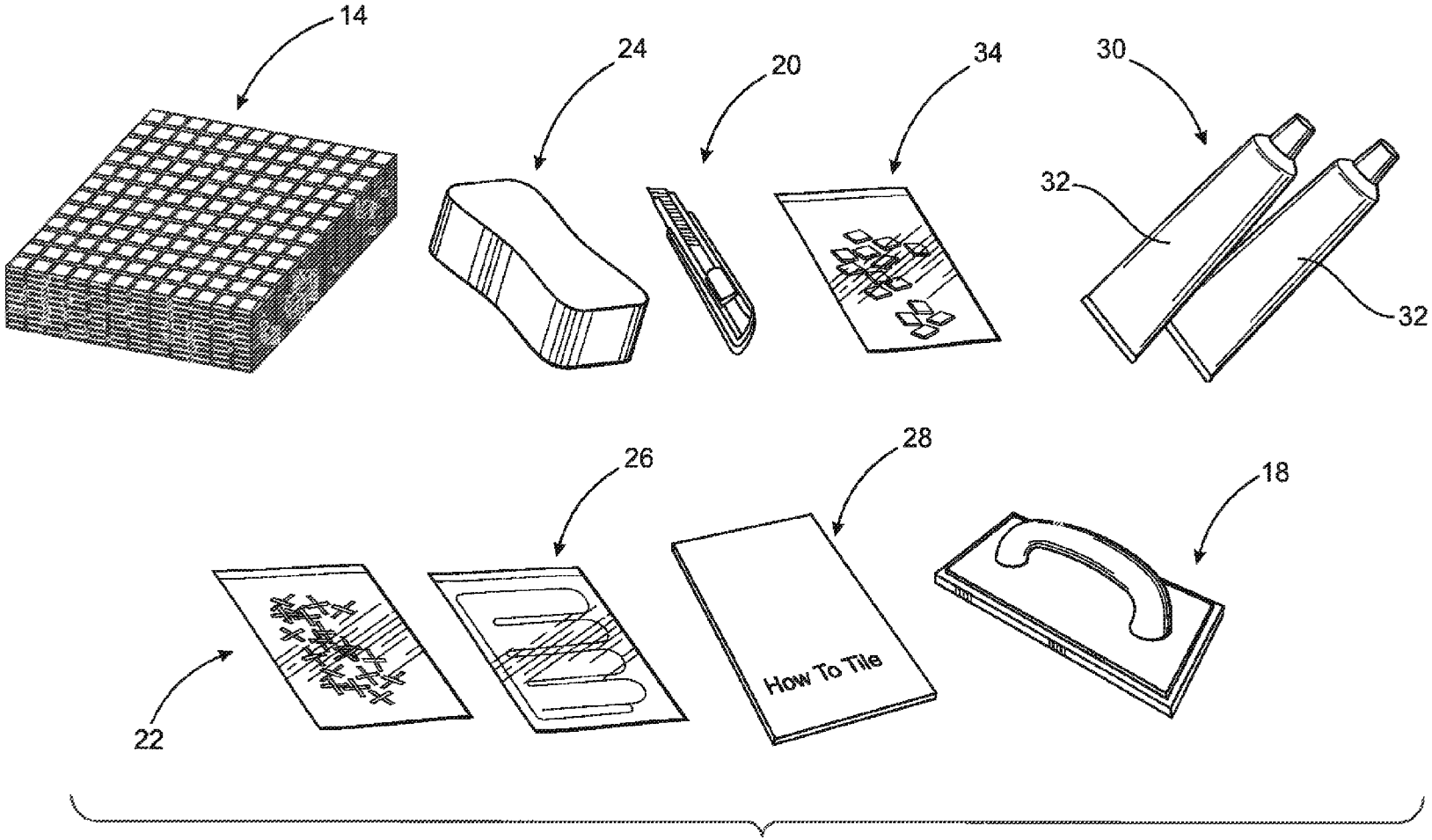
FIG. 2 is a collective view in perspective of the various installation materials and installation tools accompanying the kit assembly of the embodiment of FIG. 1.
Figure 3:
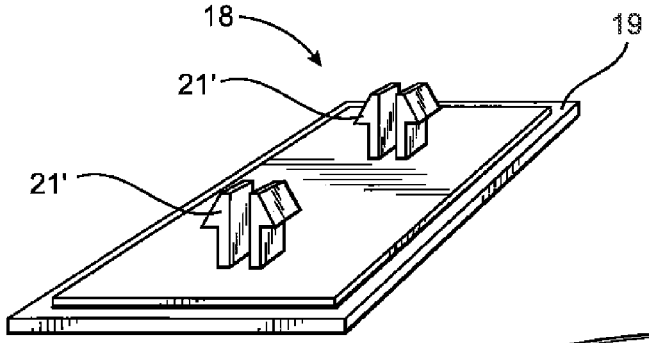
FIG. 3 is a perspective view of a base portion of a "grout float" used to apply grout as well as pressure to the installed one or more tile sheets accompanying the do-it-yourself kit assembly of the embodiment of FIG. 1.
Figure 4:
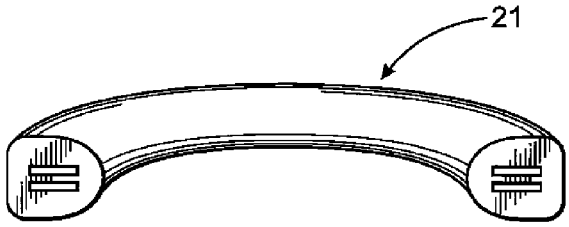
FIG. 4 is a perspective view of a handle portion of the grout float.
Figure 5:
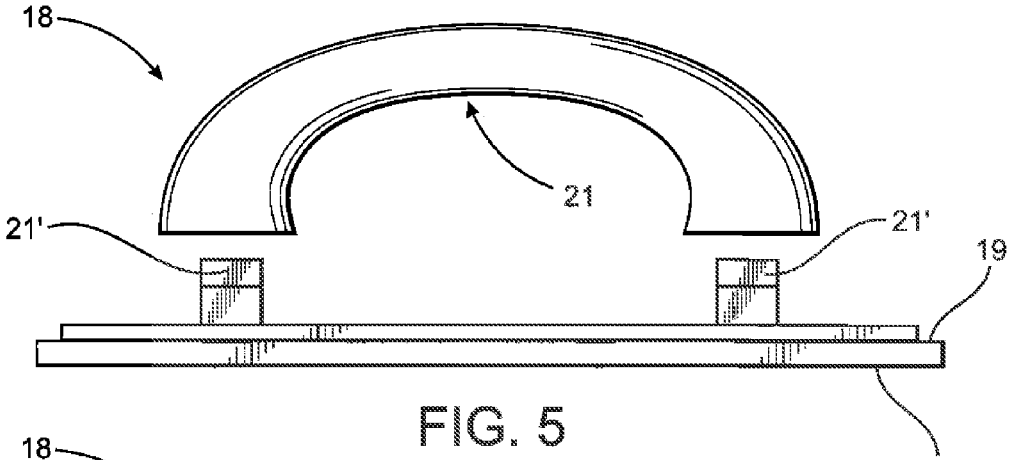
FIG. 5 is an exploded view of the handle portion and base portions of the grout float in a position to be assembled.
Figure 6:
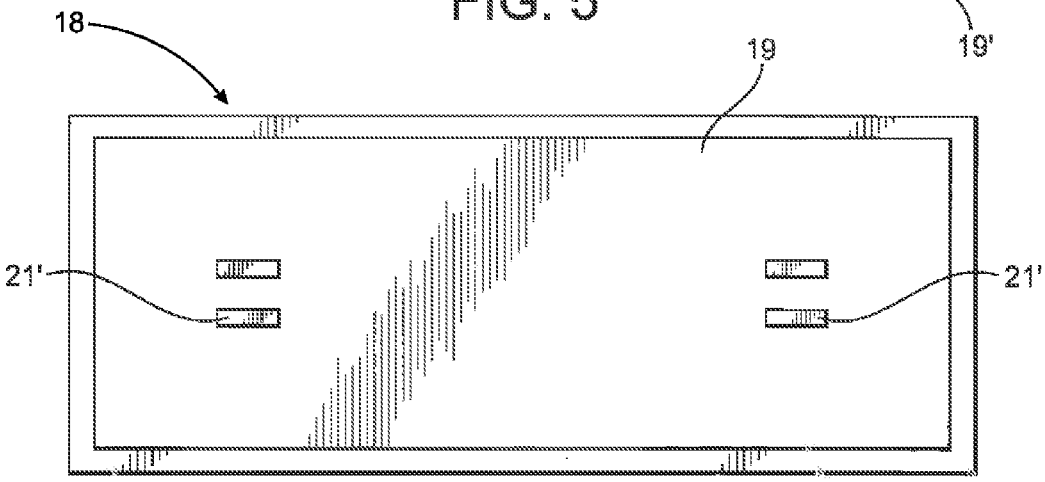
FIG. 6 is a top view of the base portion of the grout float as represented in FIGS. 3 and 5.
Figure 9:
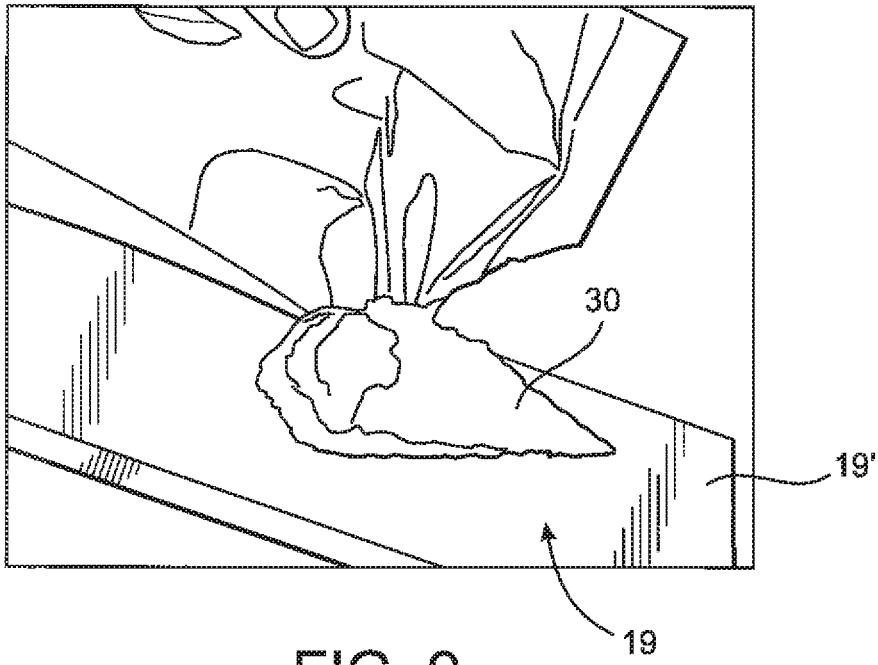
FIG. 9 is a perspective view of yet another portion of the do-it-yourself method of installation of the tile assembly kit as represented in FIG. 1.

Again with primary reference to FIG. 2, the installation tools included in the kit assembly 10 comprise a grout float 18, described in greater detail in FIGS. 3-6; a cutting blade 20, a plurality of spacers 22, a sponge 24, as well as other cleaning materials; at least one pair of gloves 26 and informational and/or instructional material, such as a printed manual and/or a DVD or other viewable media; generally indicated as 28. Yet additional installation tools may also include a screwdriver and tape measure. Installation materials included as part of the kit assembly 10 may include a supply of grout 30, provided in sufficient quantity and in one or more easily accessible containers 32. Use of the grout supply 30 will be explained with reference to at least FIGS. 9-11. Moreover, the supply of grout containers 32 are independently accessible so as to deliver the grout contained therein to the grout float 18 as generally indicated in FIG. 9, and described in greater detail hereinafter.

As also represented in FIG. 2, the tile assembly includes the one or more tile sheets 14 as well as a plurality of additional tile pieces generally indicated as 34. The tile pieces may include a plurality of elongated one piece liners 43 dimensioned, configured and structured to be mounted along and at least partially define the peripheral borders of the one or more mounted tile sheets 14, when installed on the support surface 16. Structural and operative details of the tile liners will also be discussed in greater detail hereinafter. In addition, the plurality of extra tile pieces 34 may include a plurality of loose, detached tile pieces 45 equivalent in dimension, configuration and coloring to the plurality of individual fixed tile pieces 42 formed on an exposed face or surface of each of the one or more tile sheets 14, as explained in greater detail with regard to FIGS. 11-14.

Figure 11:
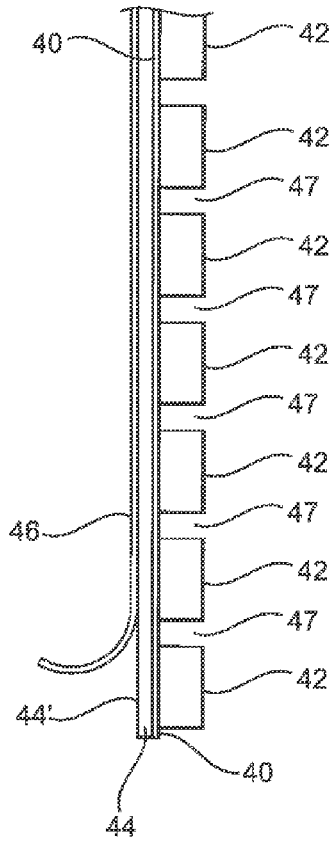
FIG. 11 is a transverse sectional view of one of a possible plurality of tile sheets included in the do-it-yourself kit assembly of FIG. 1.

Additional structural features of each of the one or more tile sheets 14 is represented in FIG. 11. More specifically, each of the tile sheets 14 may be of a predetermined size and configuration based on the size and configuration of the area of the support surface 16 on which the tile assembly is to be installed. By way of example, when the kit assembly 10 is used to cover a kitchen backsplash area of the support surface 16 the plurality of tile sheets 14 may be 15 in number, wherein each sheet has a dimension of 12 inches by 12 inches, or one square foot. As such, each of the plurality of tile sheets 14 include a backing sheet 40 formed of an appropriate material such as, but not limited to, an open mesh material. In addition, the plurality of tile pieces 42 are fixedly secured to an outer surface of the backing sheet 40 in equally spaced relation to one another. In addition, each of the fixed tile pieces 42 may or may not be of an equivalent dimension and configuration. However, each of the tile pieces 42 is appropriately coordinated at least in terms of color, texture, etc. to provide an overall visually pleasing appearance when mounted on the support surface 16. Moreover, in at least one preferred embodiment of the present invention, the tile pieces 42, as well as the one or more tile liner pieces 43 and the individual loose tile pieces 45 are formed of a mosaic, glass material. It is emphasized that other materials, such as ceramic material, can be used to form the individual tile pieces 42 as well as the liners 43 and loose tile pieces 45.

Each of the plurality of tile sheets 14 also includes an adhesive layer 44 extending over the entirety of the corresponding opposed surface of the backing sheet 40, relative to the placement of the plurality of tile pieces 42. Finally, a cover sheet 46 is removably disposed in overlying, covering and somewhat protecting relation to the surface 44' of the adhesive layer 44 so as to prevent any inadvertent adherence of the one or more sheets 14 to other objects.

While the composition of the adhesive layer 44 may vary, one preferred embodiment includes the adhesive layer comprising a cross-linked polyethylene foam, double-coated with a rubber based adhesive, composed of organic and synthetic elastomers. As such, the adhesive layer 44 is accurately described as being at least partially "pressure sensitive" as at least partially represented in FIG. 8. The pressure sensitive characteristics of the adhesive layer 44 is such that during the do-it-yourself method of installation each of the one or more tile sheets 14 may be "dry-fitted" to the support surface 16 in order to accomplish a proper alignment, orientation and/or positioning relative to one another and to the disposed area of the support surface 16 itself. More specifically, the adhesive composition is such that when a first predetermined or minimal pressure is applied to the adhesive layer 44, it may be disposed in removable confronting engagement with the support surface 16. This allows adjustment in the alignment or orientation of each of the plurality of sheets 14. However when proper alignment or orientation has been accomplished, a second predetermined or significantly greater pressure is applied to the exterior or exposed portions of the plurality of tile pieces 42, thereby fixedly securing the corresponding tile sheet 14 to the support surface 16 in a substantially permanent manner.

Figure 12:
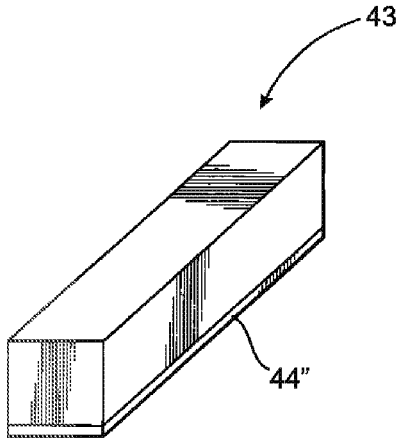
FIG. 12 is a perspective view of a tile liner piece of the tile assembly of the do-it-yourself 0kit assembly of FIG. 1.
Figure 13:
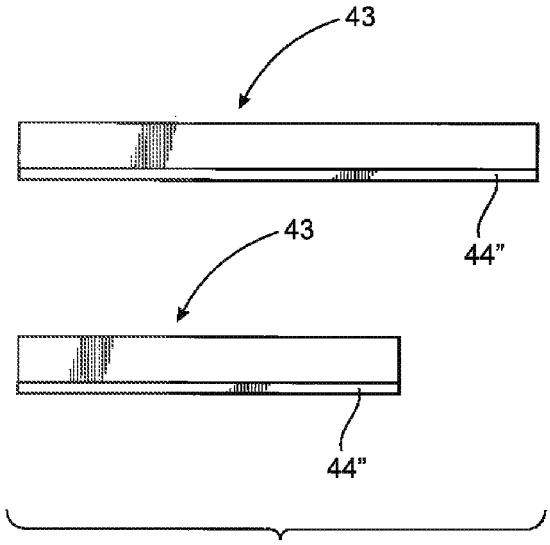
FIG. 13 is a collective view of a plurality of tile liner pieces included in the do-it-yourself kit assembly of FIG. 1.
Figure 14:
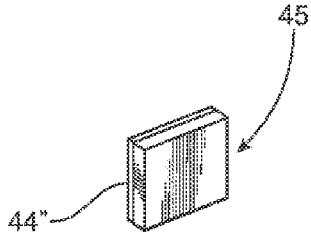
FIG. 14 is a perspective view of one of a plurality of loose tile pieces included in the do-it-yourself kit assembly of FIG. 1.

Further with regard to FIGS. 12-14, each of the plurality of liner tiles 43 may be of different lengths but have a solid, one piece construction of the mosaic, glass material corresponding to the material from which the plurality of fixed tile pieces 42 are formed. In addition, an adhesive layer, as at 44", may be secured to the undersurface of each of the plurality of liners 43 so as to facilitate the fixed and substantially permanent positioning thereof about the peripheral borders of the installed tile sheets 14. Similarly, the individual loose tile pieces 45 may include an adhesive layer backing as at 44". The loose tile pieces 45 are used to replace any damaged or missing fixed tile pieces 42 when such is found necessary.

Appropriate liner material may also be associated with the tile liner pieces 43 as well as the loose tile pieces 45.

Other structural features of the do-it-yourself kit assembly 10 specifically relating to the grout float 18 are represented in FIGS. 3-6. More specifically, the grout float generally indicated as 18 includes a base 19 and a handle 21 connected to one another by connecting members 21', as demonstrated in the exploded view of FIG. 5. Moreover, the base 19 is formed of an at least partially flexible material and includes an outer waterproof or water resistant covering 19'. One purpose of the grout float 18 is for the spreading and distribution of the grout supply 30 over the exposed surface of the plurality of fixed tile pieces 42. In distributing the supply of grout 30 it is first delivered to and effectively spread over the exposed surface 19' of the base 19 of the grout float 18, as represented in FIG. 9. For convenience, the supply of grout 30, including that retained within the various grout containers 32, is in a ready to use form. Once applied to the grout float 18 the grout supply 30 is spread over the exposed surface or faces of the plurality of fixed tiles 42. To this extent the grout is sufficient in quantity and texture to fill each of the grout junctions or channels 47 extending about the periphery of each of the fixed tile pieces 42 and specifically between adjacent ones of the tile pieces 42.

Another feature of the grout float 18 is its ability to apply a greater, predetermined pressure to the exposed face of the plurality of tile pieces 42 once properly positioned and secured to the support surface 16. As set forth above, the second predetermined or greater pressure is applied to the tile sheet 14 by pressing the confronting surface 19' of the base 19 over the exposed face of each of the plurality of fixed tiles 42 to a degree sufficient to fixedly adhere the adhesive layer 44 to the support surface 16 in a substantially permanent manner. Accordingly, the flexibility of the base 19 should be sufficient to be at least partially compressed against the exposed or outer face of the plurality of tiles 42, without causing damage thereto.

With primary reference to FIGS. 7-10, the preferred do-it-yourself method of installation of the kit assembly 10 is sequentially represented. More specifically, the area of the support surface 16 to which the one or more tile sheets 14 are to be applied should be thoroughly cleaned so as to remove any grease, dust, debris, particles, etc. which would interfere with the adherence of the tile sheets 14 to the support surface 16. Cleaning may be accomplished utilizing a plurality of different cleaning solutions to properly prepare the support surface 16.

Thereafter, as represented in FIG. 7, the specific area of the support surface 16 is measured and compared with and/or coordinated to a first or subsequent one of the plurality of tile sheets 14. This coordination may result in a determination of differences in the dimension and configuration of the support surface 16 and that of the tile sheets 14. Upon such an occurrence, the cutting blade 20 included within the kit assembly 10 can be used to cut through the corresponding tile sheet 14 by directing the blade to pass through the backing sheet 40, the adhesive layer 44 and the cover sheet 46. In doing so, the cutting blade 20 may pass into appropriate ones of the grout channels or grout junctions 47 and between adjacently positioned ones of the fixed tile pieces 42, as desired.

Once the dimension and configuration of the tile sheet 14 and the surface area 16 has been established, there may be a "dry-fitting" of the cover sheet to the surface area 16 as generally represented in FIG. 8. In doing so, the cover sheet 46 is at least minimally removed from preferably a lower end or periphery of the tile sheet 14 and the tile sheet is bent or folded into an orientation where the adhesive layer 44 may be disposed in confronting relation to the corresponding portion of the support surface 16. In accomplishing this dry-fitting procedure, only a first predetermined or minimal amount of pressure is applied to the outer or exposed face of the tile sheet 14. This will allow the adhesive layer 44 to removed from the support surface 16 at least one or two times, such that the corresponding tile sheet 14 can be properly aligned, oriented and positioned. Once the proper alignment has been established, the cover sheet 46 is completely removed thereby exposing the entirety of the adhesive layer 44 and allowing the exposed surface 44' thereof to be disposed in confronting relation to the support surface 16. Once so positioned, the grout float 18 is applied to the exposed frontal portions of the plurality of fixed tiles 42 in a manner which supplies a second predetermined or greater pressure to the tile sheet 14. This greater pressure will be sufficient to accomplish a substantially permanent adherence of the tile sheet 14 and adhesive layer 44 to the support surface 16.

Figure 10:
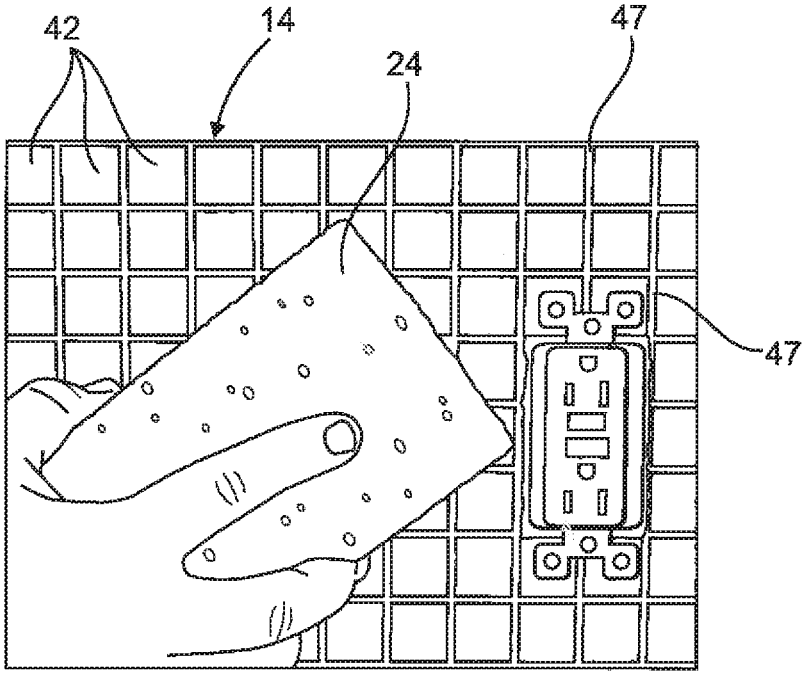
FIG. 10 is a perspective view of yet another portion of the do-it-yourself method of installation of the kit assembly of the embodiment of FIG. 1.

As represented in FIGS. 9 and 10, the supply of grout 30 is then applied to the surface 19' of the base 19 and spread continuously over the entire surface area of the mounted tile sheets 14. This is accomplished by a predetermined or preferred directional stroking in a manner which efficiently accomplishes the filling of each of the grout junctions or grout channels 47 with the grout material 30. A sufficient time of generally about 30 minutes is provided to allow the grout to dry. Thereafter, a moistened sponge 24 is utilized, as well as possibly other cleaning materials, to remove any excessive grout from the face of the fixed tiles 42. This cleaning of the excessive grout is accomplished in a manner which allows the at least partially dried grout within the grout junctions 47 to remain. Other features demonstrated in FIG. 10 is the removal of any obstacles or objects from the support surface 16 using an included screwdriver, such as the removal of a face plate covering a socket.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A do-it-yourself method of mounting a self adherent tile assembly to a support surface, the method comprising:

preparing at least one tile sheet including coordinating a dimension and configuration of one tile sheet segment with that of a portion of the support surface on which the one tile sheet segment is to be mounted, disposing a first exposed surface portion of an adhesive layer of the one tile sheet segment in confronting relation to the support surface, aligning the one tile sheet segment with the support surface by applying a first predetermined pressure to the one tile sheet segment sufficient to removably dispose the exposed portion to the support surface, exposing a remainder of the surface of the adhesive layer of the one tile sheet segment and disposing the entire exposed surface of the adhesive layer in confronting relation to the support surface, and applying a second predetermined greater pressure to the one tile sheet segment sufficient to fixedly secure the one tile sheet segment to the support surface in a substantially permanent manner.

2. A method as recited in claim 1 further comprising measuring the portion of the support surface corresponding to the size of the one tile sheet segment with the measured portion.

3. A method as recited in claim 2 further comprising severing and removing at least one portion of the one tile sheet segment to shape the remainder of the one tile sheet segment to the portion of the support surface.

4. A method as recited in claim 3 comprising dry-fitting the remainder of the one tile sheet segment to the measured portion of the support surface.

5. A method as recited in claim 1 comprising partially removing a cover sheet of the tile assembly prior to disposing the first exposed portion in confronting relation to the support surface.

6. A method as recited in claim 1 comprising applying grout material over an exposed surface of a plurality of tile pieces defining an outer face of the tile sheet and into grout joints disposed between the plurality of tile pieces.

7. A method as recited in claim 1 further comprising affixing a plurality of liner tiles each including an elongated configuration of one piece construction and an adhesive layer secured to an undersurface thereof, each of said liner tiles dimensioned and configured to extend along at least a portion of a peripheral border of the tile sheet.

8. A method as recited in claim 1 wherein the tile assembly comprises:

a backing sheet of predetermined dimension and configuration, said backing sheet formed of an open mesh material of construction structured to receive and retain an amount of applied grout, a plurality of tile pieces collectively secured to an outer face of said backing sheet in spaced, fixedly interconnected relation to one another, wherein said plurality of tile pieces are disposed in spaced relation to one another on said backing sheet; adjacent ones of said plurality of tile pieces separated by grout channels, wherein said grout channels and said outer face of said backing sheet are collectively structured to receive and retain a corresponding predetermined amount of applied grout, an integral adhesive layer secured to a rear face of said backing sheet in opposing relation to said plurality of tile pieces, and said adhesive layer disposed and structured to fixedly secure said backing sheet to the support surface on a substantially permanent basis, wherein said plurality of tile pieces, said backing sheet and said adhesive layer are collectively and sufficiently flexible to facilitate predetermined orientation of said plurality of tile pieces on the support surface.

9. A method as recited in claim 8 wherein said adhesive layer, backing sheet and cover sheet are collectively severable; said plurality of tile pieces separable to define at least one tile sheet segment of reduced size and configuration relative to the predetermined dimension of said backing sheet.

10. A method as recited in claim 8 wherein said plurality of tile pieces comprises a plurality of mosaic, glass tile pieces.

11. A method as recited in claim 8 wherein said plurality of tile pieces are substantially equivalent in dimension and configuration.

12. A method as recited in claim 8 further comprising affixing a plurality of liner tiles each including an elongated configuration of one piece construction and an adhesive layer secured to an undersurface thereof, each of said liner tiles dimensioned and configured to extend along at least a portion of a peripheral border of the tile sheet.

13. A do-it-yourself method of mounting a self adherent tile assembly to a support surface, the method comprising:

preparing at least one tile sheet including coordinating a dimension and configuration of one tile sheet segment with that of a portion of the support surface on which the one tile sheet segment is to be mounted, disposing a first exposed surface portion of an adhesive layer of the one tile sheet segment in confronting relation to the support surface, aligning the one tile sheet segment with the support surface by applying a first predetermined pressure to the one tile sheet segment sufficient to removably dispose the exposed portion to the support surface, exposing a remainder of the surface of the adhesive layer of the one tile sheet segment and disposing the entire exposed surface of the adhesive layer in confronting relation to the support surface, and applying grout material over an exposed surface of a plurality of tile pieces defining an outer face of the tile sheet and into grout joints disposed between the plurality of tile pieces.

14. A method as recited in claim 13 further comprising applying a second predetermined greater pressure to the one tile sheet segment sufficient to fixedly secure the one tile sheet segment to the support surface in a substantially permanent manner.

15. A method as recited in claim 13 wherein said tile assembly comprises:

a backing sheet of predetermined dimension and configuration, said backing sheet formed of an open mesh material of construction structured to receive and retain an amount of applied grout, a plurality of tile pieces collectively secured to an outer face of said backing sheet in spaced, fixedly interconnected relation to one another, wherein said plurality of tile pieces are disposed in spaced relation to one another on said backing sheet; adjacent ones of said plurality of tile pieces separated by grout channels, wherein said grout channels and said outer face of said backing sheet are collectively structured to receive and retain a corresponding predetermined amount of applied grout, an integral adhesive layer secured to a rear face of said backing sheet in opposing relation to said plurality of tile pieces, and said adhesive layer disposed and structured to fixedly secure said backing sheet to the support surface on a substantially permanent basis, wherein said plurality of tile pieces, said backing sheet and said adhesive layer are collectively and sufficiently flexible to facilitate predetermined orientation of said plurality of tile pieces on the support surface.

16. A method as recited in claim 15 wherein said adhesive layer comprises a pressure activated composition structured to removably secure said plurality of tile pieces and said backing sheet to the support surface upon the first predetermined pressure being applied to said plurality of tile pieces.

17. A method as recited in claim 16 further comprising applying a second predetermined greater pressure to the one tile sheet segment sufficient to fixedly secure the one tile sheet segment to the support surface in a substantially permanent manner, wherein said pressure activated composition is further structured to fixedly secure said plurality of tile pieces and backing sheet to the support surface upon the second predetermined pressure being applied to said plurality of tile pieces.

18. A method as recited in claim 13 comprising partially removing a cover sheet of the tile assembly prior to disposing the first exposed portion in confronting relation to the support surface.

19. A method as recited in claim 13 further comprising affixing a plurality of liner tiles each including an elongated configuration of one piece construction and an adhesive layer secured to an undersurface thereof, each of said liner tiles dimensioned and configured to extend along at least a portion of a peripheral border of the tile sheet.

* * * * *